United States Patent [19]

Mills

[11] Patent Number: 4,979,475

[45] Date of Patent: Dec. 25, 1990

[54] ROCKER ARM WITH ROUNDED CHANNEL TO ENGAGE A VALVE STEM WITH SEMI-SPHERICAL END

[75] Inventor: Jesse V. Mills, Toledo, Ohio

[73] Assignee: Henley Manufacturing Holding Company, Inc., Hampton, N.H.

[21] Appl. No.: 528,417

[22] Filed: May 25, 1990

[51] Int. Cl.[5] ..... F01L 1/18

[52] U.S. Cl. ..... 123/90.39; 123/90.41; 74/519

[58] Field of Search ..... 123/90.39, 90.41, 90.44, 123/90.47; 74/519

[56] References Cited

U.S. PATENT DOCUMENTS

| | | | |
|---|---|---|---|
| 4,430,783 | 2/1984 | Wherry | 123/90.39 |
| 4,697,473 | 10/1987 | Patel | 123/90.39 |
| 4,796,483 | 1/1989 | Patel et al. | 123/90.39 |
| 4,825,717 | 5/1989 | Mills | 123/90.39 |
| 4,829,647 | 5/1989 | Anderson et al. | 123/90.39 |
| 4,848,180 | 7/1989 | Mills | 74/519 |

FOREIGN PATENT DOCUMENTS

| | | | |
|---|---|---|---|
| 0131805 | 6/1988 | Japan | 123/90.39 |

*Primary Examiner*—Charles J. Myhre

*Assistant Examiner*—Weilun Lo

*Attorney, Agent, or Firm*—Allen D. Gutchess, Jr.

[57] ABSTRACT

A cold-formed rocker arm of the cam-follower type is specifically designed for variable-lift engines. The rocker arm comprises a one-piece metal body preferably of generally inverted U-shaped cross section throughout most of its length. The body has a top wall and two side walls extending downwardly therefrom and carrying an axle on which a cam-contacting roller is rotatably mounted and exposed through a central opening in the top wall above the roller to be engaged by a tapered cam of a cam shaft. The rocker arm has a substantially semi-spherical recess at one end to receive an end of a lifter post on which the rocker arm can pivot. The other end of the body has an open-ended channel extending longitudinally of the body to receive a rounded upper end of a valve stem. A lubrication port in the top wall of the rocker arm communicates with an inner end and with a clearance in a central portion of the channel. The clearance provides a lubrication path for the flow of oil along the channel. Sliding contact is obtained between the valve stem and the channel during operation yet the rocker arm resists transverse forces caused by the tapered cam of the variable-lift cam shaft.

14 Claims, 2 Drawing Sheets

ROCKER ARM WITH ROUNDED CHANNEL TO ENGAGE A VALVE STEM WITH SEMI-SPHERICAL END

This invention relates to a rocker arm of the cam-follower type particularly for use with a variable-lift cam shaft.

The rocker arm in accordance with the invention is of the cam-follower type and is made by cold-forming operations, including stamping, coining, staking, and back-packing. The rocker arm has a one-piece metal body which is of inverted U-shaped cross section substantially throughout its length. The body has a top wall with two structurally-integral side walls depending therefrom. The rocker arm body includes a rounded, substantially semi-spherical recess formed at one end portion thereof to receive an upper rounded end of a lifter post upon which the rocker arm can pivot. The other end portion of the rocker arm has an open-ended channel which is straight in longitudinal section and is of substantially semi-cylindrical transverse cross section throughout a substantial portion of its length. The channel receives an upper rounded end of a valve stem with sliding contact resulting between the rounded upper end and the channel along the channel during the operation of the rocker arm. An inner end of the channel is rounded and has a radius substantially equal to the radius of the channel as viewed in transverse cross section. Preferably, a lubrication hole is formed in the top wall of the rocker arm and communicates with the inner end portion of the rocker arm channel.

An intermediate portion of the top wall of the body has a substantially rectangular opening therethrough. The side walls of the body below the opening have axially-aligned openings which receive an axle. The axle is suitably affixed to the side walls of the rocker arm to prevent longitudinal movement of the axle. A roller is located on the axle, preferably with needle bearings therebetween with the roller extending substantially between the side walls of the body. A portion of a circumferential surface of the roller is exposed below or projects through the rectangular opening so as to be contacted by a cam of the cam shaft.

The rocker arm in accordance with the invention is especially designed for use with a variable-lift cam shaft having tapered cams thereon. The design of the rocker arm enables it to be maintained in its proper transverse location even though angularly positioned with respect to the axis of the cam shaft. The channel in the one end of the rocker arm with the semi-cylindrical shape assures that the channel and the valve stem will remain in alignment even though the rounded end of the valve stem slides along the channel during rocking movement of the rocker arm in various positions along the width of the tapered cam of the cam shaft.

It is, therefore, a principal object of the invention to provide a rocker arm particularly for use with a variable-lift cam shaft of an internal combustion engine.

Another object of the invention is to provide a rocker arm with a channeled end portion which enables the rocker arm to engage an upper end of a valve stem in slidable contact therewith.

Many other objects and advantages of the invention will be apparent from the following detailed description of a preferred embodiment thereof, reference being made to the accompanying drawings, in which.

Figure 1:
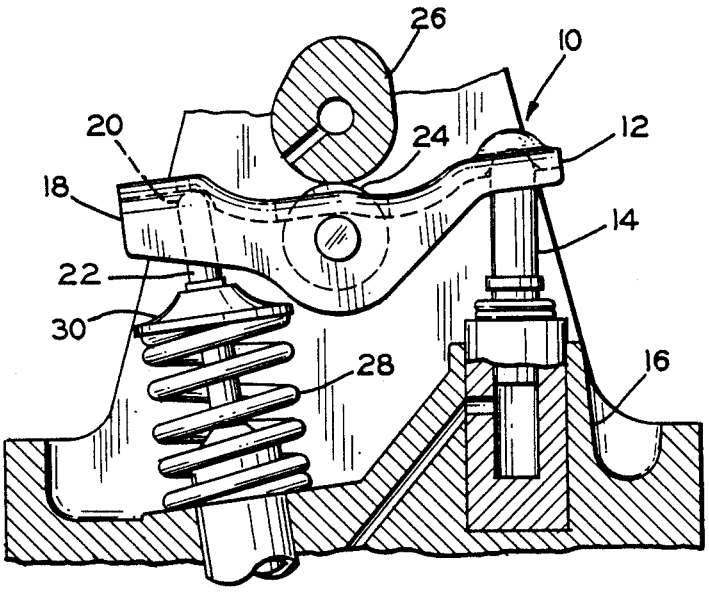
FIG. 1 is a somewhat schematic view in cross section, with portions in elevation, of valve-actuating mechanism including a rocker arm in accordance with the invention.

Referring particularly to FIG. 1, a cold-formed rocker arm of the cam-follower type in accordance with the invention is indicated at 10. An end portion 12 of the rocker arm engages an upper end of a rocker arm fulcrum or lifter post 14 extending upwardly from a cylinder head 16 of an internal combustion engine. Another end portion 18 of the rocker arm engages a rounded upper end 20 of a valve stem 22. A cam-contacting roller 24 is rotatably carried by an intermediate portion of the rocker arm and is positioned to engage a tapered overhead cam 26 of a cam shaft.

Figure 5:
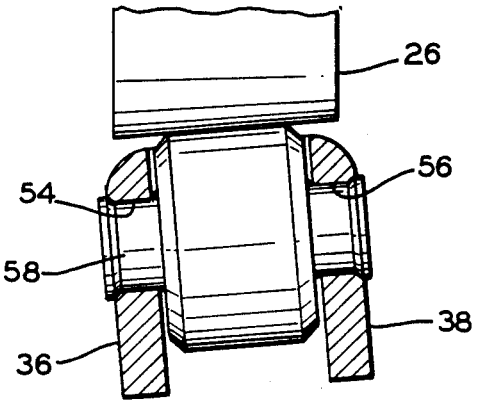
FIG. 5 is a schematic view in transverse cross section taken through a central portion of the rocker arm of FIG. 3 and a portion of a tapered cam engaged by the rocker arm.

The valve stem 22 extends upwardly from the cylinder head 16 through a coiled compression spring 28 located therearound. The spring is seated against the cylinder head 16 and against a retainer ring 30 which is mounted on the valve stem 22. The rotation of the overhead cam 26 causes the rocker arm 10 to pivot on the lifter post 14 to cause a valve (not shown) located at the lower end of the valve stem 22 to open and close as the stem is moved longitudinally by the rocker arm. The cam 26 is tapered over its width, as schematically shown in FIG. 5, so that the amount of movement imparted to the valve stem 22 by the rocker arm 10 can be varied as the cam 26 is moved transversely relative to the roller 24 by longitudinal movement of the cam shaft on which the cam 26 is formed. Consequently, the rocker are 10 assumes an angular transverse position relative to the horizontal, as schematically shown in FIG. 5, rather than the usual horizontal position. This results in transverse forces on the rocker arm which tend to move it transversely relative to the lifter post 14 and the valve stem 22. The unique design of the rocker arm 10 enables the transverse forces to be resisted and to enable sliding contact between the valve stem 22 and the end portion 18 of the rocker arm during operation of the engine.

Figure 2:
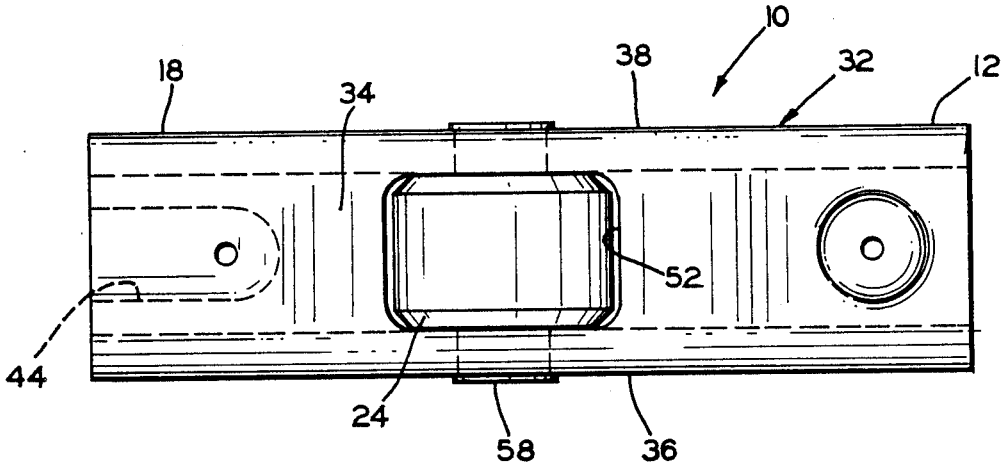
FIG. 2 is an enlarged top view of the rocker arm of FIG. 1.
Figure 3:
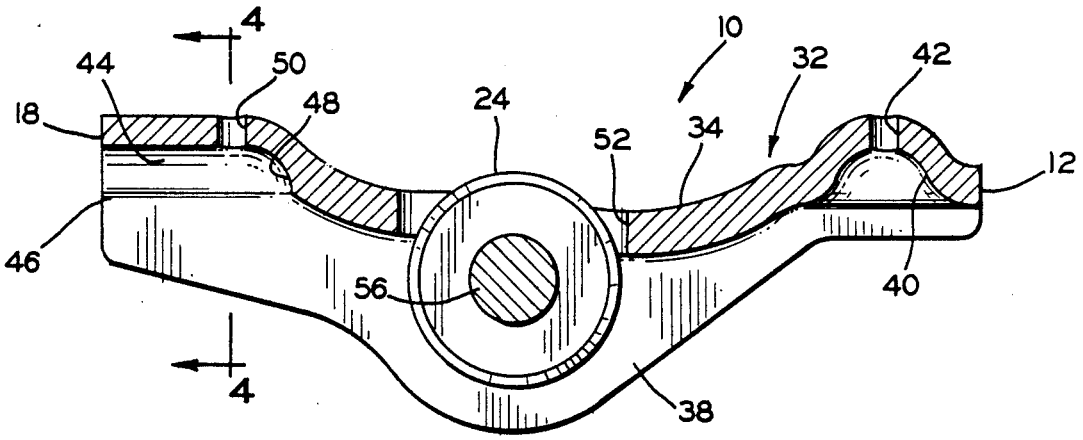
FIG. 3 is a view in longitudinal cross section taken through the rocker arm of FIG. 2.
Figure 4:
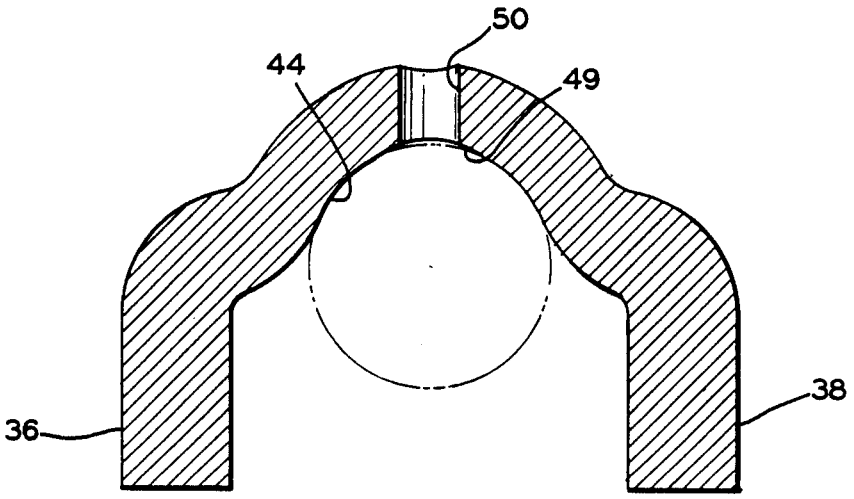
FIG. 4 is a greatly enlarged view in transverse cross section taken along the line 4—4 of FIG. 3.

Referring more particularly to FIGS. 2–4, the rocker arm 10 includes a one-piece, cold-formed metal body 32 which is made by cold-forming operations, such as stamping, coining, staking and back-packing. The body 32 is of inverted U-shaped cross section throughout substantially most of its length and includes a top wall 34 with structurally-integral, depending side walls 36 and 38. The first end portion 12 of the body has a first, rounded recess 40 of segmented, substantially semi-spherical shape in transverse cross section to receive in close relationship a rounded upper end of the lifter post 14, as is known in the art. A lubrication or oil opening 42 formed through the top wall 34 communicates with the recess 40 for lubricating purposes.

The second end portion 18 of the body 32 has a second recess 44 therein in the form of a closed end channel. As shown in FIG. 3, the channel 44 is straight as viewed in longitudinal cross section, having an open end 46 at the end 18 of the rocker arm body 32 and having a rounded, closed end 48. As viewed in transverse cross section in FIG. 4, the channel 44 is of segmented, substantially semi-cylindrical shape for a substantial portion of its length to receive the rounded upper end of the valve stem 22 which is of segmented, substantially semi-spherical shape. A central portion of the channel 44 has a smaller radius to provide clearance 49 (FIG. 4) above the rounded edge of the valve stem 22. This clearance establishes a lubrication path for the flow of oil along the channel 44. A lubrication port 50 is symmetrically located relative to the channel 44 near the rounded, closed end 48 thereof to provide lubrication, particularly for the sliding contact between the valve stem 22 and the channel 44.

The surfaces of the recess 40 and the channel 44 are coined when formed to provide close tolerances to maintain the rocker arm body 32 in alignment when the recess and channel are engaged with the lifter post 14 and the valve stem 22, respectively. This prevents transverse or lateral movement of the rocker arm 10 during operation thereof even though it is subject to substantial transverse forces due to the contact of the roller 24 with the tapered cam 26. At the same time, however, the unique design of the straight channel 44 enables it to be in sliding contact with the end of the valve stem 22 to accommodate the angular position of the rocker arm 10 relative to the cam 26.

An intermediate portion of the top wall 34 has a rectangular opening 52 through which a portion of the circumferential surface of the roller 24 is exposed or projects. The width of the rectangular opening is substantially equal to the width of the top wall 34 so as to extend completely between the inner surfaces of the side walls 36 and 38. The side walls have axially-aligned openings 54 and 56 therein which receive an axle 58 on which the roller 24 is mounted, preferably with needle bearings (not shown) therebetween, as is known in the art. The ends of the axle 58 are staked to prevent longitudinal movement of the axle relative to the rocker arm.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A cold-formed, variable-lift rocker arm of the cam-follower type comprising a one-piece metal body of generally inverted U-shaped cross section throughout its length, said body having a top wall and two side walls extending downwardly therefrom and structurally integral therewith, said top wall having a generally rectangular, central opening therein, said side walls of said body having axially-aligned openings therein below said central opening, an axle extending through said aligned openings and affixed to said side walls to prevent longitudinal movement of said axle, a roller located on said axle and extending substantially between said side walls of said body, a portion of a circumferential surface of said roller being exposed from above through said rectangular opening, said body having means at one end to receive an end of a lifter post, and said body having an open-ended channel at the other end, extending longitudinally of said body and terminating at the other end of said body to receive an upper end of a valve stem, said upper end of said valve stem being substantially semi-spherical and said channel having a complementary substantially semi-cylindrical transverse cross section at least throughout a substantial portion of its length.

2. A cold-formed rocker arm according to claim 1 wherein an inner end of said channel terminates in a rounded portion having a radius substantially equal to the radius of the rounded cross section of said channel.

3. A cold-formed rocker arm according to claim 2 wherein said inner end of said channel has a lubrication port communicating with an inner end portion of said channel.

4. A cold-formed rocker arm according to claim 3 wherein a central portion of said channel has a smaller radius and communicates with said lubrication port to provide a lubrication path for the flow of oil along said channel.

5. A cold-formed, variable-lift rocker arm of the cam-follower type comprising a one-piece metal body of generally inverted U-shaped cross section throughout its length, said body having a top wall and two side walls extending downwardly therefrom and structurally integral therewith, said top wall having a generally rectangular, central opening therein, said side walls of said body having axially-aligned openings therein below said central opening, an axle extending through said aligned openings and cooperating with said side walls to prevent longitudinal movement of said axle, a roller located on said axle and rotatable with respect thereto, said body having recess means at one end to receive an end of a lifter post, and said body having reception means extending longitudinally of said body at the other end thereof to receive an upper end of a valve stem to prevent transverse movement of said other end of said body relative to said valve stem and to enable longitudinal movement of said other end of said body relative to the upper end of the valve stem, said reception means being formed by a substantially semi-cylindrical portion of equal radius at least throughout a substantial portion of its length.

6. A cold-formed rocker arm according to claim 5 wherein said reception means comprises a channel extending longitudinally of said body.

7. A cold-formed rocker arm according to claim 6 wherein said channel has an open end opening at said other end of said body.

8. A cold-formed rocker arm according to claim 6 wherein an inner end of said channel terminates in a rounded portion having a radius substantially equal to the radius of the rounded cross section of said channel.

9. A cold-formed rocker arm according to claim 6 wherein an inner end of said channel has a lubrication port communicating with an inner end portion of said channel.

10. A cold-formed rocker arm according to claim 9 wherein a central portion of said channel has a smaller radius and communicates with said lubrication port to provide a lubrication path for the flow of oil along said channel.

11. A cold-formed, variable-lift rocker arm of the cam-follower type comprising a one-piece metal body including a top wall, said top wall having a central opening therein, said body rotatably carrying a cam-contacting roller on an axis below said central opening, said body having means at one end to receive an end of a lifter post, and said body having an open-ended channel at the other end, said open-ended channel being substantially straight as viewed in longitudinal cross section of said body and extending longitudinally of said body, and said channel having a substantially semi-cylindrical transverse cross section at least throughout a substantial portion of its length complementary to a substantially semi-spherical upper end of a valve stem.

12. A cold-formed rocker arm according to claim 11 wherein an inner end of said channel terminates in a rounded portion having a radius substantially equal to the radius of the rounded cross section of said channel.

13. A cold-formed rocker arm according to claim 12 wherein an inner end of said channel has a lubrication port communicating with an inner end portion of said channel.

14. A cold-formed rocker arm according to claim 13 wherein a central portion of said channel has a smaller radius and communicates with said lubrication port to provide a lubrication path for the flow of oil along said channel.

* * * * *